United States Patent [19]

Westberg

[11] Patent Number: 4,510,720

[45] Date of Patent: Apr. 16, 1985

[54] HONING CONTROL SYSTEM

[76] Inventor: Russell C. Westberg, 5100 W. 106th St., Bloomington, Minn. 55435

[21] Appl. No.: 479,554

[22] Filed: Mar. 28, 1983

[51] Int. Cl.[3] ..... B24B 33/02

[52] U.S. Cl. ..... 51/34 J; 51/165.93

[58] Field of Search ..... 51/34 H, 34 R, 34 J, 51/34 C, 34 D, 165.93, 57, 290

[56] References Cited

U.S. PATENT DOCUMENTS 3,237,350 3/1966 Estabrook ..... 51/290

4,189,871 2/1980 Rottler et al. ..... 51/345

4,423,567 1/1984 Raven ..... 51/31 R

*Primary Examiner*—Frederick R. Schmidt

*Assistant Examiner*—Robert A. Rose

*Attorney, Agent, or Firm*—Harold D. Jastram

[57] ABSTRACT

A honing control system which can be balanced to independently control the honing and release stroke of a honing machine by utilizing a system incorporating a combination of air and liquid pressure to balance and regulate power and release stroke of the system uses a combination of liquid flow control and air exhaust control to regulate and balance the stroke speed of a honing head.

4 Claims, 1 Drawing Figure

HONING CONTROL SYSTEM

BACKGROUND OF THE INVENTION

Businesses in the auto parts recondition industry recognize the constant need for producing accurately honed automotive motor cylinders. The machine industry producing the machines for this reconditioning industry continuously seeks machines, methods and systems for increasing the accuracy, efficiency and ease of producing accurately reconditioned automotive parts and increased productivity.

Typically, the small businesses which recondition automobile engines and make other automotive repairs have a need for honing machines and reboring machines which have the capability of ease of operation by an operator. These machines should be capable of long term operation and manual application of the honing device to the automotive cylinder by operators who have relatively little experience operating machines.

Because of the nature of the wear encountered in used automotive motors, the honing machines used in such shops should incorporate a system having a dwell capability. This permits the operator to cause the honing head to dwell at the bottom of the cylinder in order to get a uniform and true cylinder. It is well known in the industry that an automotive cylinder wears in a tapered shape. Most of the wear taking place at the top of the cylinder and relatively less of the wear occuring at the bottom of the cylinder. Accordingly, the honing machine used to "true" the cylinder walls must have the capability of dwelling slightly longer at the bottom of the cylinder to remove more of the cylinder wall at that point in order to produce a quality refinished product. Therefore, the operator should have the capability of maintaining the honing tool in contact with the lower part of the cylinder wall for a predetermined period of time during the stroke of the honing tool.

The prior art has attempted to provide machines of this type with varying degrees of success. Certain of these machines have provided systems that are quite complicated and expensive and in many cases are much more complicated and expensive than desirable for these small reconditioning establishments. An example of such a honing machine is illustrated by U.S. Pat. No. 4,189,871. Much of the prior art, including the referenced patent, provide systems which incorporate complicated control systems that nevertheless tend to be difficult to balance and control by hand operation. Many of these machines do not have the capability of precision control of the stroking phase of the machine nor are they capable of the required dwell for producing accurate and precision reconditioning of cylindrical surfaces.

SUMMARY OF THE INVENTION

The present invention provides a honing control system of simple construction and reliable operation for controlling the operation of manually operated honing machines.

Another object of the present invention is to provide a honing machine control system incorporating control mechanisims for insuring a dwell at one point in the stroke of a honing machine for producing accurate machine parts.

A further object of the present invention is to provide a honing machine system utilizing a combination of air and liquid to balance the control system and vary the stroke speed of a honing tool.

Yet another object of the present invention is to provide a honing control system designed to provide variable stroke speeds and stroke pause by varying the exhaust of air from the control system.

DESCRIPTIONS OF THE DRAWINGS

In the accompanying drawings FIG. 1 schematically illustrates a honing machine control system for controlling the stroke operation of a honing machine and insure proper balance and stroke control.

DETAILED DESCRIPTION OF A PREFERRED EMBODIMENT OF THE INVENTION

Figure 1:
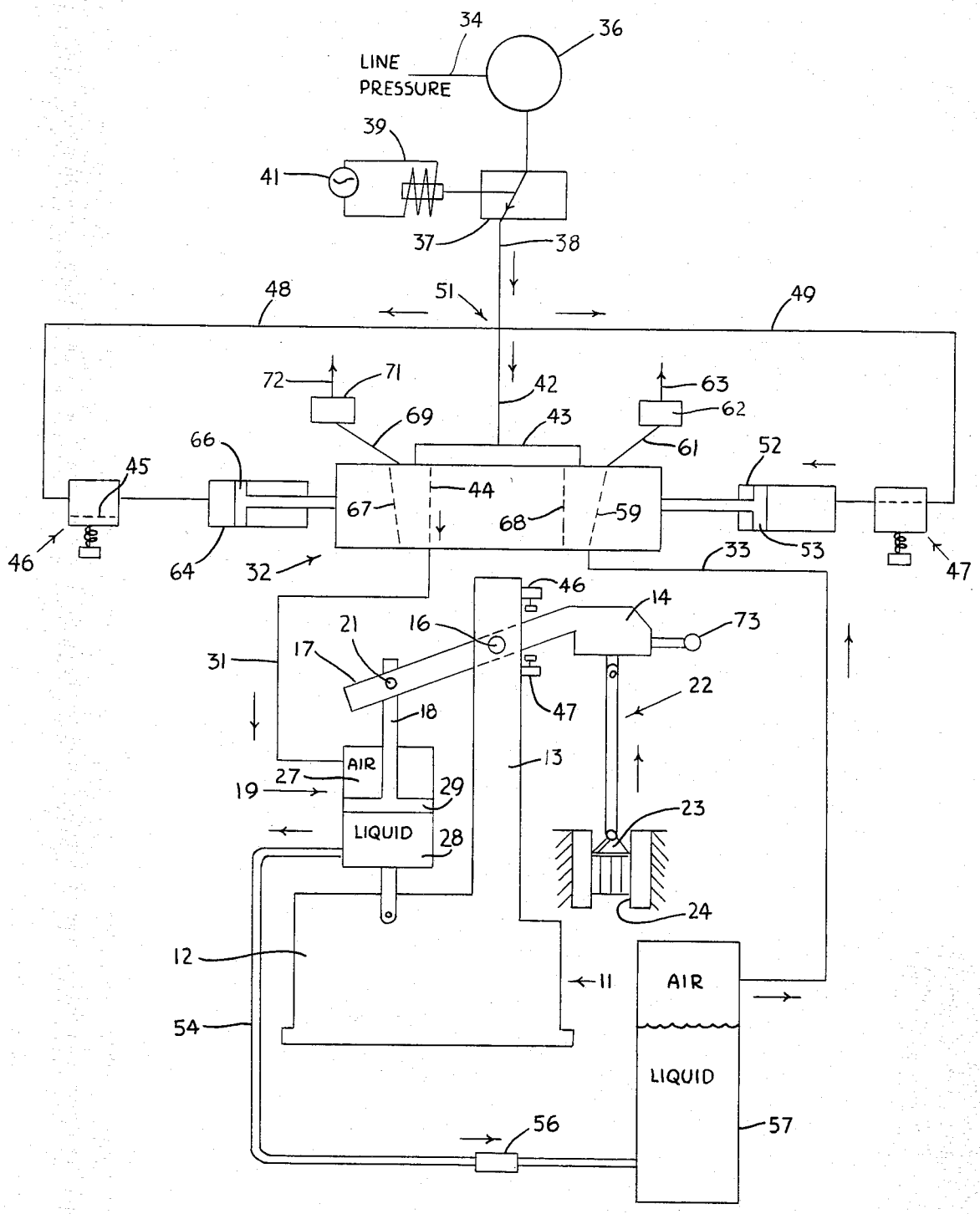

The drawings illustrate a honing machine generally designated by the numeral 11 and illustrated in schematic form. The honing machine 11 has a base 12. A column 13 is attached to base 12 and acts as a support for a power unit 14. Power unit 14 is attached to column 13 at pivot point 16. Power unit 14 extends beyond the column 13 and has an extension 17 to which the power shaft 18 of a cylinder 19 is attached at pivot point 21.

At the other end of the power unit 14 is a honing tool assembly generally designated by numeral 22. The honing tool assembly 22 is designed to move reciprocally as illustrated in the drawing in a vertical direction to place the honing tool 23 into contact with cylinder 24 during the operation of the system. Typically, cylinder 24 is the cylinder of an automotive motor block which is being reconditioned. In such a cylinder, the cylinder has typically been worn from use in a conical shape with the top of the cylinder having greater wear than the bottom of the cylinder. For this reason, it is desirable and necessary to cause the honing tool 23 to pause at the bottom of the cylinder and thereby remove more material from the bottom of cylinder 24 than from the top of the cylinder. The control system attached to the honing machine 11 is designed to produce this pause.

Cylinder 19 is connected by shaft 18 to the arm 17 of the power unit 14. The other end of cylinder 19 is mounted on base assembly 12. Cylinder 19 is designed to have an air chamber 27 and a liquid chamber 28. The two chambers are separated by piston 29 which operates shaft 18 to apply power to the power unit 14. As the piston 29 moves vertically upward in the drawings, the power unit 14 is pivoted about pivot point 16 to move the honing unit 22 vertically downward into cylinder 24. A reversal of the piston 29, reverses the action and withdraws the honing tool 23 from the cylinder 24.

Air is the operating medium to cause cylinder 19 to function. Air is directed into cylinder 19 through line 31 which is directly connected to a spool valve 32. Spool valve 32 is an example of a valve with a multitude of functions. it is designed to apply air to two different lines. In the schematic diagram shown in the drawings, the spool valve 32 is shown in a position where air is being directed into line 31 to force piston 29 downwardly. Attention is specifically directed to the small arrows adjacent the air lines in the schematic. This shows the direction of flow of air in the particular embodiment of the invention demonstrated with spool valve directing air into line 31 in a first of its operating phases. Movement of spool valve 32, as will be later explained, will also direct the air into line 33 and terminate line pressure on line 31.

Air is directed from line 34 through pressure regulator 36 through an on-off solenoid operated switch 37 into line 38. Air switch 37 is simply an on-off switch designed to turn on the entire system by applying line pressure to line 38 of the system. This air switch 37 is operated by electrical solenoid 39 which is connected to an electrical source 41. Air is directed to the spool valve 32 through line 42 and manifold 43 and thence into spool valve 32. With the spool valve 32 in the position illustrated in the drawings, air moves from line 42 through manifold 43 and into line 31 through air channel 44 of spool valve 32.

Air pressure is also applied from line 38 to an upper limit valve 46 and a lower limit valve 47 through lines 48 and 49 respectively. This is accomplished by utilizing a T connection 51 in order to distribute air from line 38 to lines 42, 48 and 49. It should be noted at this point, that upper and lower limit valves 46 and 47 are mounted on column 13 of the honing machine 11. Switches 46 and 47 are mounted so that they are activated by the action of power unit 14 when it moves the honing tool assembly vertically into and out of cylinder 24. The drawings show the upper and lower limit valves 46 and 47 in two different locations; however, this is done only for illustrative purposes since the valves are shown in their mechanical location in the mounting on column column 13 but are shown in their function position in lines 48 and 49 respectively. These are not multiple valves but are the same valve.

In the operational mode depicted in the figures, the power unit has just completed operation of lower limit valve 47 and has opened the line 49 to permit air to flow into control valve actuater 52. Actuater 52 is a small piston-operated cylinder. The actuater 52 contains a operating piston 53 which forces the spool valve or control valve 32 to the left as viewed in the drawing. This moves the channel 44 into alignment with manifold 43 and line 31 so that air flows from line 42 through the control valve or spool valve 32, into line 31 and into air chamber 27 of cylinder 19. This forces the piston 29 downwardly in the drawing against the liquid in liquid chamber 28. This downward movement of piston 29 lowers arm 17 of the power unit 14 and moves the honing assembly 22 vertically upward to withdraw the honing tool 23 from the cylinder 24.

Liquid is forced out of liquid chamber 28 through fluid line 54 and through fluid flow regulator 56. Liquid flow regulator 56 regulates the diameter of the opening through which fluid can flow from chamber 28 into reservoir 57. The fluid in reservoir 57 pushes air out of the reservoir into air line 33 which is connected to reservoir 57 in a section of the reservoir filled with air. Reservoir 57 is only partially filled with fluid as depicted in the drawings.

Air travels from the reservoir 57 through line 33 and into control valve 32 through channel 59. Channel 59 is aligned with an exhaust line 61. In a preferred embodiment of this invention, line 61 is connected to an exhaust regulator 62 which is a control variable to reduce the air flow or increase the air flow of the exhaust from the system. By reducing the oriface of the exhaust, the air flow out of the exhaust port 63 can be reduced to resist the liquid flow between liquid chamber 28 and reservoir 57. This reduced rate of exhaust, resists the downward movement of piston 29 and thereby reduces the speed at which the honing tool 23 is removed from the cylinder 24. In this way, the honing tool 23 can be caused to pause in the cylinder and thereby increase the honing action at the bottom of the cylinder 24.

Liquid flow regulator 56 is used to balance the system and control the liquid flow between chambers 28 and the reservoir 57. This also will vary the rate of flow of the fluid in the system and will result in an increase or decrease of the speed of movement of the tool assembly 22.

After the power unit 14 moves a predetermined distance, it engages upper limit valve 46. When upper limit valve 46 is actuated, the valve 46 aligns the flow channel 45 in valve 46 with the line 48 to permit air to enter control valve actuator 64. This control valve actuator is exactly the same type as actuator 52 and contains a piston 66 which at this point is forced to the right thus forcing control valve 32 to the right as viewed in the drawings. When this occurs, channel 67 is moved into alignment with line 31. Channel 44 is moved out of alignment with line 31 and thus becomes inactive. During this phase of the movement, channel 68 moves into alignment with line 33 so that air flows from line 42 through manifold 43 and into line 33 in a reverse direction of that described hereinabove. The channel 59 is, in this phase of the operation, moved out of alignment of lines 33 and 61 and therefore becomes inactive. In this mode of operation, the system is reversed in its operation and the cylinder 19 drives the power unit 14 in the opposite direction to force the honing tool assembly 22 downwardly in a vertical direction and into cylinder 24 thus completing one full cycle of the system.

This mode of the operation also utilizes an exhaust line 69 which is aligned with channel 67 to exhaust air from chamber 27 through line 31 and into line 69 through exhaust regulator 71 and into exhaust port 72. The exhaust regulator 71 is exactly the same as exhaust regulator 62 and is used for the purpose of varying the rate at which air is exhausted from the control valve 32.

Thus it can be seen that with independent exhaust regulators 62 and 71, the regulators can be varied to alter the speed of the power unit 14. The system can be balanced with the use of the exhaust regulators 71 and 62 so that the tool assembly can have a rapid descent or a slow descent. Likewise the system can be reversed so that the tool honing assembly 22 has a slow descent and a rapid withdrawal. Further, the system can be balanced if desired so that the descent and ascent of the tool assembly 22 in the vertical direction is equal. Thus it can be seen that varying the exhaust regulators 62 and 71 give a wide variety of control options. An operator who is operating the machine may also apply manual pressure to handle 73 to vary the stroke. The application of manual pressure to handle 73 is an operational option in the system in addition to fully automatic operation.

Because liquid is used in cylinder 19 and reservoir 57 and is forced to flow back and forth between these two units, the entire system is balanced and operates much more smoothly than if only air is used in this control system. Since liquid does not tend to compress, it acts as a uniform medium for transmitting energy between cylinder 19 and reservoir 57. This provides a cushioning effect in the system and insures efficient and uniform movement of the power head 14. As earlier noted, a flow regulator 56 can also be adjusted for a wide variety of applications to increase or decrease the rate of operation of the entire system. Opening the regulator 56 of course would tend to permit more rapid liquid flow from the liquid chamber 28 to the reservoir 57 and also the reverse and thereby increase the speed at which the power unit 14 operates. Restriction of the orifice along line 54 through flow regulator 56 would of course slow the transfer of fluid and thereby slow the speed of operation of the power head 14. This is an independent control from the exhaust port regulators 62 and 71 since these regulators can also be varied as previously described to balance the system independently.

The above-described operation of the control system is merely illustrative of the principles of the invention and is not to be considered to be a limitation thereof. For instance, control of spool valve 32 can be varied as long as the type of valve or air pressure transfer system performs the function of reversing the system in response to upper and lower limit switches 46 and 47. The particular kind of control valve is not important. Further, there is no absolute need for an on-off switch for starting the system as depicted by solenoid operated valve 37. Other variations of the system can be achieved and practiced the principles of invention.

What is claimed is:

1. A honing machine system comprising a base assembly, a power unit pivotally mounted on said base assembly and having a first and second end, a honing tool assembly connected to a first end of said power unit for vertical reciprocal movement, a cylinder means mounted on said base assembly, a piston in said cylinder connected at a second end to said power unit for reciprocally moving a first end and honing tool in a vertical direction, said piston separating said cylinder means into an air chamber and a liquid chamber, an air and liquid reservoir, means for interconnecting the liquid sides of said reservoir with the liquid chamber of said cylinder means, a reciprocating control valve, a first control valve actuator for moving said control valve in a first direction, a second control valve actuator for moving said control valve in a second direction, air source means for supplying air pressure to said control valve and said first and second actuators, said control valve interconnecting said air source means and said air chamber and said reservoir, said control valve having first and second air exhaust ports, a lower limit valve mounted on said base assembly operated by contact with said power unit and interconnecting said first actuator and said air source means, and an upper limit valve mounted on said base assembly operated by contact with said power unit and interconnecting said second actuator and said air source means, said power unit engages said upper and lower limit valves to operate said first and second actuators to reciprocate said control valve and direct air pressure into and out of said air chamber and reservoir and exhaust the air through said first and second air exhaust ports against the dampening action of liquid flowing between the liquid side of reservoir and said liquid chamber.

2. A machine system in accordance with claim 1 in which said first and second exhaust ports each have an exhaust regulator attached to independently vary the rate of air exhaust from said ports and thereby vary the rate of ascent descent of the power unit during the honing operation.

3. A machine system in accordance with claim 2 in which a liquid flow regulator is connected between said liquid chamber and reservoir to regulate the liquid flow between said chamber and reservoir and thereby regulate the rate of the vertical reciprocal movement of said power unit.

4. A machine system in accordance with claim 3 in which said air source means includes an air pressure regulator to vary the air line pressure delivered to said control valve.

* * * * *